United States Patent [19]

Bartholomäus et al.

[11] Patent Number: 4,518,938

[45] Date of Patent: May 21, 1985

[54] SOLENOID HAVING LOW-FRICTION COATING INTERNALLY OF THE ARMATURE SLEEVE

[75] Inventors: Reiner Bartholomäus, Neuendorf; Christoph Gibas, Neunkirchen, both of Fed. Rep. of Germany

[73] Assignee: Mannesmann Rexroth GmbH, Lohr, Fed. Rep. of Germany

[21] Appl. No.: 585,164

[22] Filed: Mar. 1, 1984

[30] Foreign Application Priority Data

Mar. 18, 1983 [DE] Fed. Rep. of Germany ..... 3309904

[51] Int. Cl.[3] ..... H01F 7/08

[52] U.S. Cl. ..... 335/262; 335/255; 335/270

[58] Field of Search ..... 335/255, 251, 260, 262, 335/257, 258, 270, 277

[56] References Cited

U.S. PATENT DOCUMENTS 4,149,132 4/1979 Richter et al. ..... 335/262
4,278,959 7/1981 Nishimiya et al. ..... 335/262

FOREIGN PATENT DOCUMENTS 3136174 3/1983 Fed. Rep. of Germany ..... 335/262

*Primary Examiner*—George Harris
*Attorney, Agent, or Firm*—Cushman, Darby & Cushman

[57] ABSTRACT

Electromagnet solenoid with a housing in which a winding support supporting the magnet winding is arranged, having an armature which supports at least one stem and is mounted to be capable of moving to and fro within the winding support, and with end pieces terminating the housing. For guiding the armature a sleeve made of magnetic material is provided within the winding support, and said sleeve has on its surface directed towards the armature a sliding coating defining an air gap (i.e. a space free of magnetic material,) and in addition to serving for guiding the armature the said sleeve serves for redirecting magnetic flux.

19 Claims, 2 Drawing Figures

SOLENOID HAVING LOW-FRICTION COATING INTERNALLY OF THE ARMATURE SLEEVE

The invention relates to an electromagnet (solenoid), more particularly a switch magnet and also a proportional magnet. The invention also relates to magnetically operated valves using such magnets. The magnet according to the invention can be constructed both as a pressure-tight magnet and also as a magnet operating in oil. The magnet according to the invention is suitable for clutch transmission or engine applications.

The invention concerns also more particularly an electromagnet with a housing in which a winding support supporting the magnet winding is arranged, with an armature which is mounted to be movable to and fro within the winding support, and which comprises at least one stem and with end pieces terminating the housing. For example the German laid-open specification No. 31 36 174.9 shows an electromagnet of this category wherein, for supporting the armature, use is made on the one hand of a plunger or stem and on the other hand a guide stud arranged on the armature. Stem and guide stud are guided in corresponding bearing sleeves. The armature itself is surrounded by sleeves, forming an air gap. This kind of bearing arrangement is relatively complicated, and also has the following disadvantages:

- usually an eccentric air gap;
- in the air gap magnetic particles (abraded particles) are drawn in by the magnetic field and jam the magnet;
- expensive manufacture if the air gap is to be concentric;
- high friction forces due to unilateral bearing loading, and as a result considerable hysteresis.

A further known possibility of supporting the armature proposes, in place of a guide stud and the associated sleeve, that the armature itself is provided with a bronze coating for sliding purposes at its end remote from the stem. The thickness of this layer of bronze then represents the constructionally desired air gap. In such a case one would be talking of a combined bearing arrangement, but the following disadvantages occur:

- expensive manufacture, because of spraying-on and subsequent processing;
- air gap present (abraded material causes jamming);
- eccentric air gap possible still.

A further and already known bearing possibility for the armature proposes that the stem is not supported in bearing means, so that the associated sleeve is also dispensed with. Instead, the armature is coated with an antimagnetic bronze both at one end and at its other end. Again the following disadvantages occur:

- expensive manufacture because of spraying-on and subsequent processing;
- eccentric air gap almost unavoidable.

The invention has as its object to provide an electromagnet of the kind initially specified and also a magnetically operated valve operated by such an electromagnet, in such a manner as to obviate the disadvantages of the state of the art. More particularly the invention aims at providing an electromagnet and a magnetically operated valve in such a manner as to allow financially economical production and give an extremely low-friction bearing arrangement for the armature.

More particularly the measures indicated in the claims are proposed for solving the problem which the invention tackles.

Further advantages, aims and details of the invention will be apparent from particularly the description of constructional examples, with reference to the drawings. In the drawings.

Figure 1:
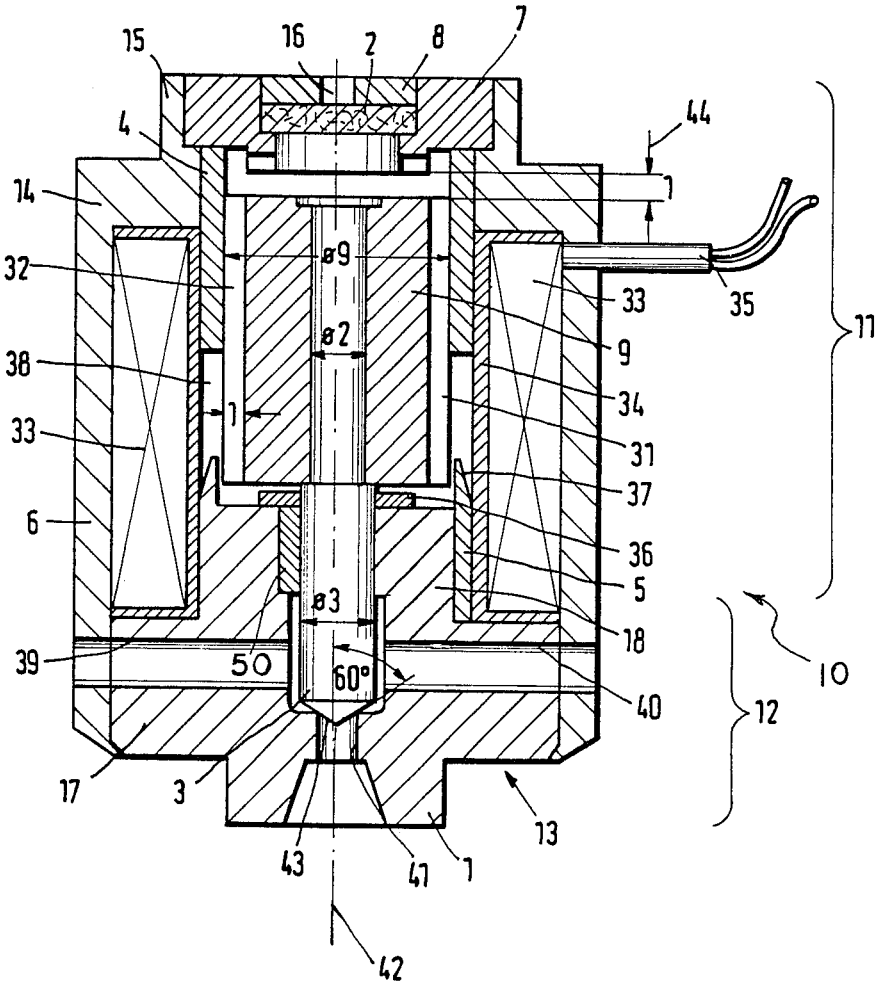
FIG. 1 shows a magnetically operated valve constructed according to the invention, with an associated electromagnet constructed according to the invention, in section view in each case.

The magnetically operated valve 10 shown in FIG. 1 comprises substantially an electromagnet (solenoid) 11 with a built-on valve 12. The electromagnet 11 is preferably a proportional magnet.

The electromagnet (solenoid) 11 has a housing 6 in the form of a case into which is inserted a cylindrical former or winding support 34 which at one end abuts on a transverse wall 14 of the housing 6. With its opposite end the winding support 34 abuts on an end piece (pole core) 13, which with a transverse section 17 fits as regards diameter into the housing 6 and with a longitudinal section 18 projects into the hollow space formed by the winding support 34. Preferably the housing 6 is beaded-over about the transverse section 17 in order thus to hold the end piece 13 in a fixed position. Projecting from the transverse section 17 in the opposite direction from the longitudinal section 18 is a seating element 1 in which a longitudinal bore 41 is constructed and which can serve for fastening to a further component not shown here. Two transverse bores 39, 40 are arranged in the transverse section diametrally oppositely with respect to one another, and also continue through the housing 6.

Within the remaining space in the electromagnet 11 there is provided adjacently to the longitudinal section 18 of the end piece 13 an armature 9 which can move to and fro and is mounted to be capable of sliding. From the armature 9 a stem 3 extends into the longitudinal bore 41 of the end piece 13 and at its lower end in FIG. 1 has a valve cone 43 which co-operates with a sealing seat formed by the longitudinal bore 41.

In the view shown in FIG. 1 the armature 9 is in its energisation or operative position, which it takes up when the magnet winding 33 situated on the winding support 34 is supplied with electrical energy via the connecting lead 35. The armature 9 reaches the position shown in FIG. 1 after travelling over the distance 44, and at the end of this travel comes to abut against a non-magnetic stop disc 36 arranged at the inner end of the longitudinal section 18 of the end piece 13. The armature 9 can be moved into its position of rest, which is not shown, by spring means or the like which are also not shown.

Preferably the armature 9 is provided with for example two longitudinal grooves 31, 32 which allow throughflow of fluids, and in fact fluid can flow from the transverse bores 39, 40, when there is no bearing 50 and support for the armature in the sleeve 5, along the stem 3 and then through the said grooves 31, 32 in an upward direction, whence the fluid can issue through a bore 16 in a housing cover 7. When there is a bearing 50 and there is no sleeve 5, i.e. the nose 37 is part of the section 17, no oil can flow freely into the magnet space. The magnet space can only be filled with air or oil through the filter 2, so that no metallic dirt can enter the magnet. Housing cover 7 is arranged in an opening formed by a longitudinal wall 15, the longitudinal wall 15 projecting from the transverse wall 14 in the direction of the longitudinal axis 42 of the electromagnet. Radially inwardly of the longitudinal wall 15 the transverse wall 14 forms a surface for supporting the housing cover 7. When a bearing 5 is provided, the central bore 16 in the housing cover 7 contains a filter 2 which is secured by means of a fastening element in the form of a ring 8. The fluid can issue and enter through the filter 2 and the central aperture of the ring 8. When there is no bearing 5, there is no filter 2.

According to the invention an armature or yoke guiding means is provided in the form of a sleeve 4 which provides sliding bearing means for the armature 9. The sleeve 4 is preferably a so-called DU sleeve. A DU sleeve has preferably a copper-plated steel backing on to which a porous layer of tin bronze powder is sintered, whereupon the pores of the bronze are completely filled with a mixture of polytetrafluoroethylene and powdered lead. Although a DU sleeve is preferred according to the invention, the sleeve 4 for guiding the armature could equally well consist of a magnetic material coated with a synthetic plastic material at the side directed towards the armature 9.

Such sleeves have an exact coating and hence an exact concentric air gap.

The sleeve 4 is—as shown in FIG. 1—split and arranged securely within the bore formed by the transverse wall 14 and the winding support 34.

The sleeve 4 is so arranged that it is used to guide the armature and at the same time for redirecting magnetic flux. Thus the non-magnetic coating, preferably polytetrafluoroethylene, applied to the magnetically conductive supporting element or steel backing, forms the "air gap" towards the armature 9.

According to the invention there is arranged in alignment with the sleeve 4 a further bearing sleeve 5 which is spaced relatively to the sleeve 4. Between the two sleeves 4 and 5 a hollow space 38 exists, and at the upwardly directed end the bearing sleeve 5 is provided with a bevelled portion 37. In this way the preferably desirable properties of a proportional magnet are achieved.

Preferably the bearing sleeve 5 also is made from DU bearing material. Only the upper region of the bearing sleeve 5 which projects above the longitudinal section 18 towards the armature 9 can serve here for bearing purposes. Otherwise the bearing sleeve 5 is situated between the longitudinal section 18 of the end piece 13 and the inner periphery of the winding support 34.

Although DU sleeves and more particularly commercially conventional DU sleeves are preferred, the invention proposes quite generally sleeves 4, 5 made of magnetisable material which are coated with a sliding coating. As mentioned, it is possible according to the invention for the control edge required for operation of the proportional magnet to be incorporated directly in one sleeve, namely the DU sleeve 5. In the construction illustrated the DU sleeve 5 also performs guide tasks, since the length relationships are so adapted that when the armature 9 is fully pushed back (not shown in the drawings) that edge of the armature which faces towards the stem side does not leave the bore of the DU sleeve 5. Thus the DU sleeve 5 acts as an additional guide for the armature 9.

As has already been mentioned, the polytetrafluoroethylene coating of the sleeve 4 in addition to reducing friction can also perform the task of magnetic flux control in the magnet according to the invention. Usually this task is performed by an "air gap", and in this case this is replaced by the polytetrafluoroethylene coating.

The non-magnetic coating of the DU sleeve 4 has the same function. It should be pointed out again that it is not absolutely necessary to use commercially conventional DU sleeves, and instead the sleeves may also in principle be made from a magnetisable material lined with a suitable sliding coating.

In the constructional example shown in FIG. 1 a further bearing sleeve 50 is inserted in the longitudinal section 18 of the end piece 13, to provide guidance for the stem 3. The bearing sleeve 50 may also be a DU sleeve if required. If the bearing sleeve 50 is used there is no sleeve 5, and the nose 37 is part of the section 17 (as illustrated for the left-hand side of sleeve 5).

Figure 2:
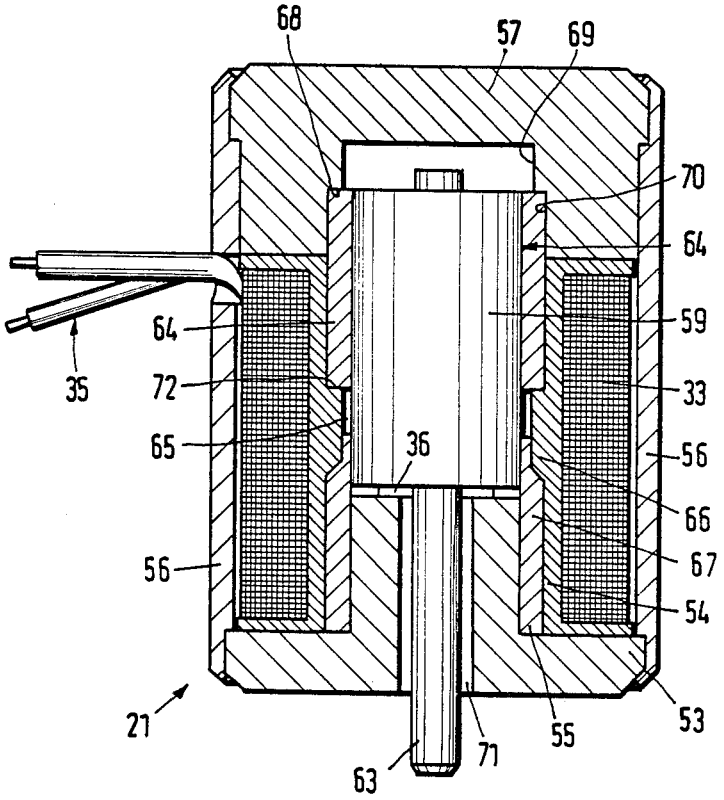
FIG. 2 shows a cross-section through a further electromagnet constructed according to the invention.

FIG. 2 shows a further constructional example of an electromagnet (solenoid) 21 constructed according to the invention. This electromagnet 21 has a housing 56 in the form of a case, into which a winding support 54 with its winding 33 is inserted, and in fact arranged between a housing cover 57 and an end piece or pole core 53. An armature 59 with its stem 63 is arranged slidably in a bore 69 within the cover 57 and also within the winding support 54. As in the constructional example shown in FIG. 1, the armature is in its excitation position. It can be displaced into its position of rest by spring means not shown. The stem 63 extends through a bore 71 in the end piece 53 and this time is not guided. However, a nonmagnetic stop disc 36 for the armature 59 is provided at the inner end of the bore 71. The housing 56 is beaded-over at its two ends in order thus to hold the housing cover 57 and the end piece 53. Suitable abutment surfaces for cover and end piece are formed in the inner wall of the housing 56, as illustrated. The armature 59 also has grooves 31, 32 which are not shown, or a throughflow bore.

A sleeve 64 rectangular in cross-section is arranged between the cylindrical inner wall of the cover 57 and the inner wall of the winding support 54 and the outer periphery of the armature 59. In more detail, the bore 69 widens to a bore 70 of larger diameter, forming an abutment surface 68 for the sleeve 64. The winding support 54 also comprises a radially disposed widening 66 which also forms an abutment surface 72 for the sleeve 64. The sleeve 64 consists preferably of DU bearing material, and is thus a so-called DU sleeve. But in principle the sleeve 64 may equally well be made of any magnetisable material provided with a corresponding sliding coating towards the armature 59. Axially aligned with the sleeve 64 in such a way as to leave a hollow space 65 between the sleeves is a further bearing sleeve 55 also situated in the bore formed by the winding support 54, and in fact it is arranged between the outer wall of the end piece 53 and the winding support 54. The upper end of the bearing sleeve 55 has a narrowed portion 67, the widening 66 of the winding support 54 being shaped correspondingly. This formation gives the circumstances needed for a proportional magnet. As already mentioned, the two electromagnets 11 and 21 which have been described are preferably proportional magnets, but they may also be constructed as so-called switch magnets. The two magnets 11, 21 and more particularly the magnetically operated valve shown in FIG. 1 may be used under oil. In such an event the magnetically operated valve 10 may be built into a transmission or an oil tank. Preferably the electromagnet conceived as a proportional magnet can also be used as a switch magnet. In this way it is possible to switch volume currents. With a proportional magnet an electrically controllable pressure limiting valve is obtained.

Although electromagnets according to the invention with DU bearing sleeves 4, 5, 64, 55 are also suitable particularly for oil-less operation, it should be pointed out that the magnet concept according to the invention is also particularly suitable for dry operation (air, gases), since in fact DU sleeves do have particular advantages also for oil-less working.

We claim:

1. A solenoid comprising:

a housing having two ends;

winding means adapted for being energized by flow of electricity;

winding support means, arranged within said housing, for supporting said winding means;

an armature mounted for reciprocal movement within said winding support means in response to energization of said winding means;

sleeve means, provided radially inward of said winding support means, for guiding said armature during its movement including a magnetically conductive supporting element provided on its inner surface with a non-magnetic low friction coating adapted to contact said armature so as to define an air gap facing said armature and a low friction bearing for said armature;

at least one stem extending from said armature;

first end piece means for closing one end of said housing;

second end piece means for closing the other end of said housing; and bearing means, provided in one of said first and second end piece means, for guiding said stem.

2. A solenoid according to claim 1, wherein said solenoid comprises a switch magnet.

3. A solenoid according to claim 1, wherein said solenoid comprises a proportional magnet.

4. A solenoid according to claim 1, wherein said sleeve means is a DU sleeve.

5. A solenoid as in claim 1 wherein said bearing means is a sleeve inserted in said second end piece means and said second end piece includes a tapered nose extending toward said first end piece about said armature.

6. A solenoid according to claim 1, wherein said sleeve means are inserted in a bore formed within the winding support means.

7. A solenoid according to claim 1, wherein said sleeve means comprises two sleeves which are axially spaced from each other so as to form a hollow space.

8. A solenoid according to claim 7, wherein at least one of said two sleeves is shaped so as to constitute a proportional magnet.

9. A solenoid according to claim 1, wherein said low-friction coating is comprised of polytetrafluorethylene.

10. A solenoid according to claim 1, wherein said sleeve means comprises a copper-plated steel backing, with the inner surface having sintered thereto a porous layer of tin bronze powder, the pores of which are filled with a mixture of polytetrafluoroethylene and lead powder.

11. A solenoid according to claim 7, wherein one of the sleeves tapers upwardly.

12. A solenoid according to claim 7, wherein one of said sleeves is inserted into a bore defined by a flange of said housing and said winding support means.

13. A solenoid according to claim 7, wherein one of the sleeves is situated between the cylindrical inner wall of said first end piece means, the inner wall of said winding support means and the outer periphery of said armature.

14. A solenoid according to claim 7, wherein a bore in the first end piece means widens to a bore of larger diameter, thereby forming an abutment surface for one of said sleeves.

15. A solenoid according to claim 7, wherein the winding support means comprises a radially extending widening which also forms an annular abutment surface against which at least one of the sleeves can come to bear.

16. A solenoid according to claim 7, including a further bearing sleeve arranged axially offset relatively to at least one of the sleeves.

17. A solenoid according to claim 15, wherein one of said sleeves is a bearing sleeve arranged in the winding support means to abut said widening provided on said winding support means.

18. A solenoid according to claim 1, including a magnetically operated valve in combination therewith to be operated by means of said solenoid.

19. A solenoid according to claim 18, wherein said value is constructed within said second end piece means.

* * * * *